US005421581A

United States Patent [19]

Smith

[11] Patent Number: 5,421,581

[45] Date of Patent: Jun. 6, 1995

[54] GAME DEVICE UTILIZING OPPOSING MAGNETIC FIELDS

[76] Inventor: Johnnie B. Smith, P.O. Box 1711, La Mirada, Calif. 90637

[21] Appl. No.: 352,916

[22] Filed: Dec. 9, 1994

[51] Int. Cl.[6] ..... A63F 3/00

[52] U.S. Cl. ..... 273/239; 273/275; 273/450; 273/456

[58] Field of Search ..... 273/239, 275, 450, 456

[56] References Cited

U.S. PATENT DOCUMENTS 2,819,904 1/1958 Nelson et al. ..... 273/239
3,427,029 2/1969 Riva ..... 273/239
3,556,526 1/1971 Currie ..... 273/239
3,714,612 1/1973 Kayle ..... 273/456 X

*Primary Examiner*—William H. Grieb
*Attorney, Agent, or Firm*—Robert T. Spaulding

[57] ABSTRACT

A game device in which opposing magnetic fields are used to position a plurality of magnetic balance tiles around the periphery of a starting magnet in accordance with a set of rules which specify unique patterns of displacement and awards points which are consistent with the degree of difficulty in replicating the patterns. The game may be played by one or more players in a group.

7 Claims, 2 Drawing Sheets

GAME DEVICE UTILIZING OPPOSING MAGNETIC FIELDS

BACKGROUND OF THE INVENTION

1) Field of the Invention

This invention relates generally to games which rely on the interactions of magnetic fields to test the skills of a player or players, and more specifically a game device which relies upon the characteristic of a magnetic field whereby magnets of like poles form a mutual field of repulsion.

2) Description of the Prior Art

Games which incorporate magnetic fields in their operation are well known in the prior art. For example, U.S. Pat. No. 3,765,679, U.S. Pat. No. 4,200,289, U.S. Pat. No. 4,211,411, U.S. Pat. No. 4,462,596, U.S. Pat. No. 4,991,836, and U.S. Pat. No. 5,265,885. All of these games utilize either attracting or repelling magnetic fields in one form or another.

However, none of the above listed games integrate the features of repelling magnets with the physical skills of a single player or a number of players.

Accordingly, one object and advantage of this invention is to provide a game which pits the skills of a player or players against the opposing fields of magnetic playing pieces.

Another object and advantage of this invention is to provide a game in which varying skill levels may be attained by introducing magnetic pieces with varying degrees of flux density, and game pads with playing surfaces that vary from a coarse texture to a smooth facade.

Another object and advantage of this invention is to provide a plurality of games, all employing the same magnetic game pieces and playing board, which challenge the skills of the player or players.

Further objects and advantages of this invention will become apparent from consideration of the drawings and ensuing description of it.

SUMMARY OF THE INVENTION

The present invention comprises a playing pad, henceforth called the Game Pad, a starting magnet, henceforth called the Home Base, and a plurality of magnetic balance tiles.

The playing pad, which may be a rigid, or alternately, flexible body structure, is placed on a suitable playing surface. The Home base is then placed on the Game Pad, with an identifying mark facing upwards, at a location chosen by the player or players. In an alternate form of the game, the Game Pad includes an aperture dimensioned to accept the Home Base, thereby defining a fixed location for the Home Base.

The object of the game is to position a magnetic balance tile in close proximity to the Home Base, with the magnetic fields of the Home Base and the tile in opposition. The edge of the tile facing the Home Base is held at an angle with the vertex of the angle formed by the edge of the tile furthermost from the Home Base, which abuts against the Game Pad, and the plane of the Game Pad. The slope of the angle is a function of the intensity of the magnetic fields, the distance from the Home Base, and the skill of the player. Properly positioned, the tile will maintain this angle when released by the player. If this is successfully done, the player then repeats this operation with the previously balanced tile now taking the place of the Home Base. Alternatively, the player may attempt to balance another tile with reference to the Home Base at a different location on the Game Pad Patterns may be formed in accordance with the rules stipulated by the game being played. Should the player mis-judge the interacting magnetic fields being created, the previously balanced tiles will collapse onto the Game Pad, destroying the pattern.

Patterns may be created with the magnetic balance tiles which vary in complexity and hence challenge the skills of the player or players. Points are then given in accordance with a set of pre-described rules and totaled to determine the winner of the game.

DESCRIPTION OF THE PREFERRED EMBODIMENT

Figure 1:
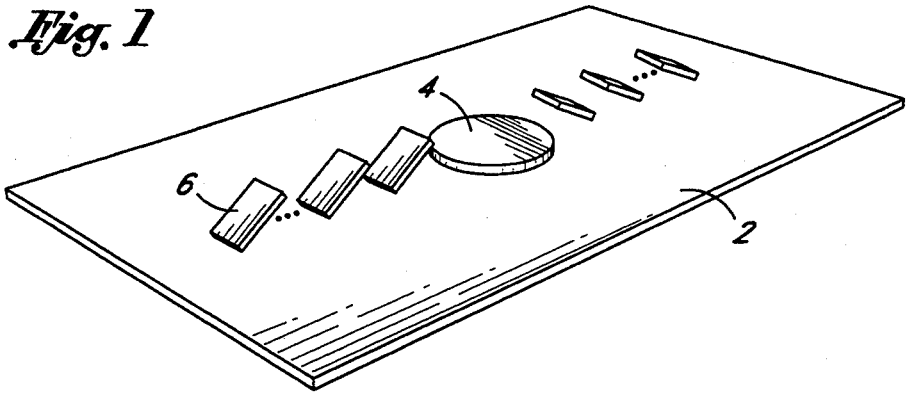
FIG. 1 shows a perspective view of the Game Pad 2 the Home Base 4 and a plurality of magnetic balance tiles 6.
Figure 2:
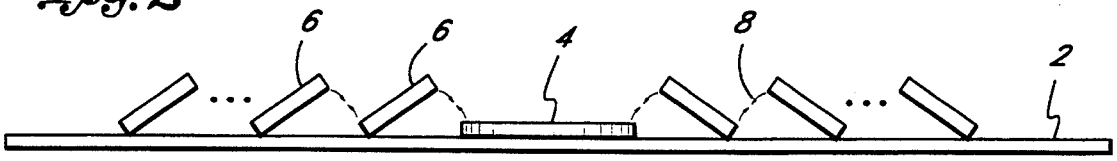
FIG. 2 shows a side view of the Game Pad 2, the Home Base 4 and a plurality of magnetic balance tiles 6. For descriptive purposes, a single line of the opposing magnetic flux densities is indicated by the dashed line 8.
Figure 3:
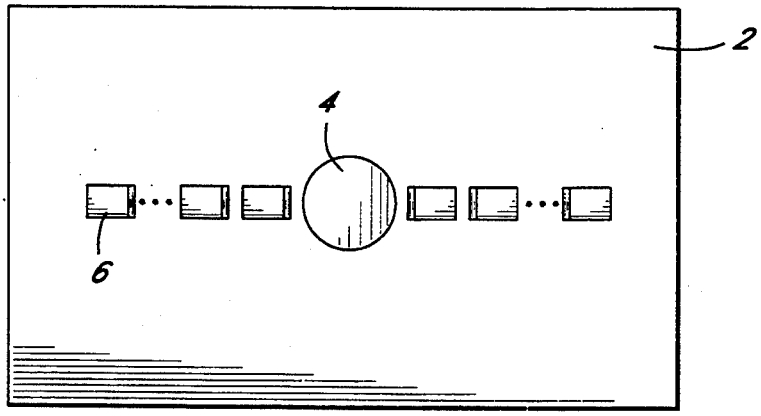
FIG. 3 shows the top view of the Game Pad 2 the Home Base 4 and a plurality of magnetic balance tiles 6.
Figure 4:
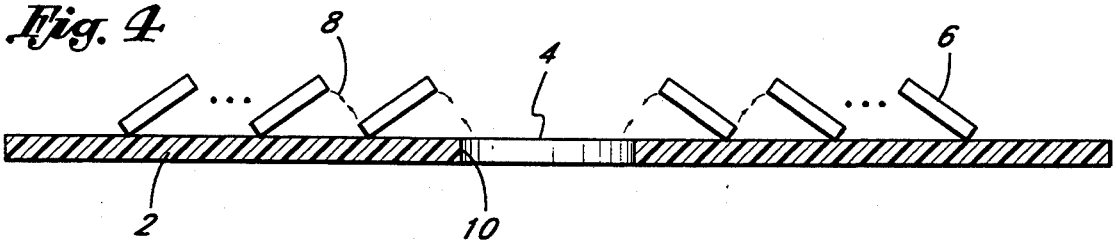
FIG. 4 shows a side view of the alternate embodiment of the Game Pad 2 in which the aperture 10 that is dimensioned to accept the Home Base is illustrated.
Figure 5:
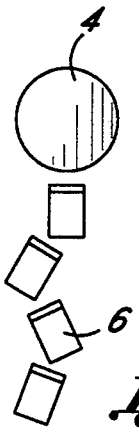
FIG. 5 shows a top view of a game illustrating the relationship between the Home Base 4 and a plurality of magnetic balance tiles 6 which are positioned in a zig zag pattern.
Figure 6:
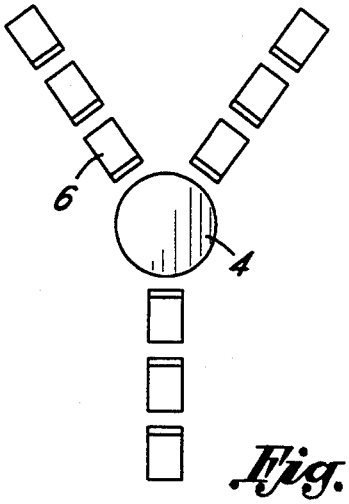
FIG. 6 shows a top view of a game illustrating the relationship between the Home Base 4 and a plurality of magnetic balance tiles 6 which are arranged in a "Y" pattern.
Figure 7:
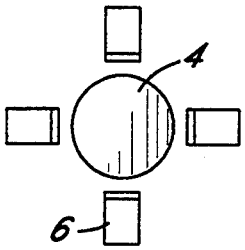
FIG. 7 shows a top view of a game illustrating the relationship between the Home Base 4 and a plurality of magnetic balance tiles 6 which are arranged in a square pattern.
Figure 8:
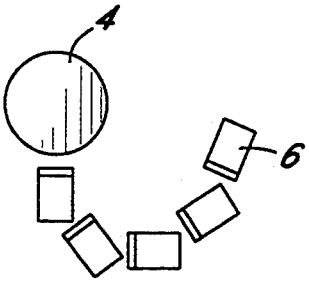
FIG. 8 shows a top view of a game illustrating the relationship between the Home Base 4 and a plurality of magnetic balance tiles 6 which are arranged in a reverse pattern.
Figure 9:
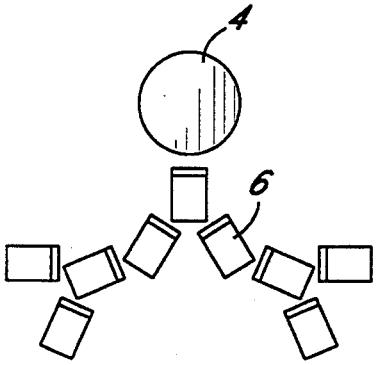
FIG. 9 shows a top view of a game illustrating the relationship between the Home Base 4 and a plurality of magnetic balance tiles 6 arranged in a half diamond double split pattern.
Figure 10:
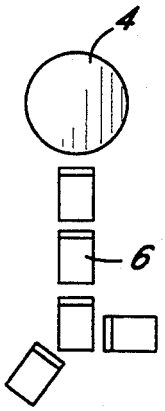
FIG. 10 shows a top view of a game illustrating the relationship between the Home Base 4 and a plurality of magnetic balance tiles 6 arranged in a split square corner pattern.
Figure 11:
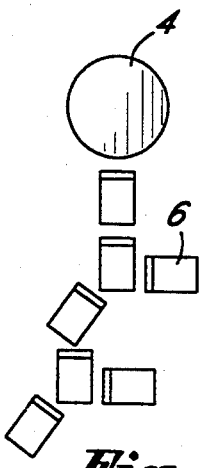
FIG. 11 shows a top view of a game illustrating the relationship between the Home Base 4 and a plurality of magnetic balance tiles 6 arranged in a square corner double split pattern.
Figure 12:
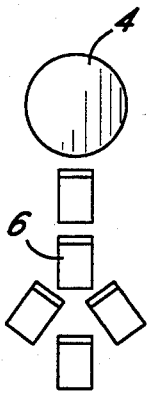
FIG. 12 shows a top view of a game illustrating the relationship between the Home Base 4 and a plurality of magnetic balance tiles 6 arranged in a double split pattern.

FIG. 1 shows the three body structures which comprise the invention: the Game Pad 2, the Home Base 4, and a plurality of magnetic balance tiles, collectively labeled 6. The Game Pad is shown to be rectangular in shape, but it could just as well be circular or perfectly square. Game pads are provided with playing surfaces that vary from a textured material which affords a purchase for the edge of the magnetic balance tile that comes in contact with it, to a game pad with a smooth surface, which challenges the skills of an advanced player or players. An alternate embodiment of the Game Pad includes an aperture dimensioned to contain the Home Base.

The Home Base is comprised of a ceramic or similar magnetic material and is disc shaped. One flat side of the Home Base is identified as the top, so that there is a consistent magnetic polarity presented to the player or players. Color coded Home Bases with varying degrees of magnetic intensity are provided in order to test the skills of the more advanced player or players.

The magnetic balance tiles are rectangular in shape and comprised of a ceramic or similar magnetic material. They are dimensioned to be picked up and manipulated comfortably with the thumb and finger. One flat side of the tile is identified as the top, so that there is a consistent magnetic polarity presented to the player or players.

To play a game, the Home Base is placed on the Game Pad, or alternatively in the aperture of the Game Pad. The player then positions a magnetic balance tile in the neighborhood of the Home Base, at an angle to the Home Base, with the edge of the tile away from the Home Base in juxtaposition with the Game Pad. Properly positioned, the tile will remain at the chosen angle when released by the player. The object of the game is to stack as many tiles as possible in a pre-determined order, in accordance with a set of stipulated rules, without mis-judging the forces generated by the interacting magnetic fields. Should this occur, the previously stacked array of tiles will collapse. Points are awarded in accordance with the skill level required, and determine the winner of the game when there is more than one player.

Although the description above contains many specifications, these should not be construed as limiting the scope of the invention, but as merely providing illustrations of some of the presently preferred embodiments of this invention. For example, the Home Base may rectangular in shape. Thus the scope of the invention should be determined by the appended claims and their legal equivalents, rather than by the examples given.

What is claimed is:

1. A game device utilizing opposing magnetic fields comprising:

a Game Pad;

a starting magnet, referred to as the Home Base, which is placed on the playing surface of Game Pad;

a plurality of magnetic balance tiles, which are positioned about the Game Pad so that the opposing magnetic fields of the Home Base and an individual tile, placed in proximity to the Home Base, cause the elevated edge of the tile facing the Home Base to remain in balance with respect to the Game Pad;

in like manner, other tiles placed on the Game Pad in proximity to previously balanced tiles will remain in balance in accordance with the player's ability to judge the effects of the interacting magnetic fields;

a set of rules which stipulate unique patterns of magnetic balance tiles and awards points to the player or players which are commensurate with the difficulty of replicating a particular pattern.

2. The game device of claim 1, in which a plurality of Game Pads are provided with playing surfaces that vary in texture to provide an additional challenge to the player or players.

3. The game device of claim 1, in which an alternate Game Pad comprises an aperture dimensioned to accept the starting magnet.

4. A game device consisting of a Game Pad, a starting magnet which is referred to as Home Base, and a plurality of magnetic balance tiles whereby the Home Base is placed on the Game Pad and the player or players attempt to use the opposing magnetic fields of the Home Base and the tiles to create patterns of tiles in which the edge of the tile closest to the Home Base or an adjacent tile is maintained at an angle with respect to the plane of the Game Pad.

5. The game device of claim 4, further including a set of rules which stipulate unique patterns of magnetic balance tiles and awards points depending upon the difficulty of replicating a particular pattern.

6. The game device of claim 4, further including a plurality of Game Pads with playing surfaces that vary in texture to provide an additional challenge to the player or players.

7. The game device of claim 4, in which an alternate Game Pad comprises an aperture dimensioned to accept the starting magnet.

* * * * *